United States Patent [19]

Bissel

[11] Patent Number: 4,712,260

[45] Date of Patent: Dec. 15, 1987

[54] WATERBED AND HOLDER ASSEMBLY FOR USE THEREWITH

[76] Inventor: Steve F. Bissel, 8 Robb Rd., Beverly, Mass. 01915

[21] Appl. No.: 49,554

[22] Filed: May 14, 1987

Related U.S. Application Data

[62] Division of Ser. No. 867,534, May 28, 1986, Pat. No. 4,683,602.

[51] Int. Cl.[4] ..... A47C 27/08; A47G 9/00

[52] U.S. Cl. ..... 5/451; 24/72.5; 5/496

[58] Field of Search ..... 5/451, 450, 496, 498, 5/482; 24/72.5

[56] References Cited

U.S. PATENT DOCUMENTS 4,486,909 12/1984 McKneelen ..... 5/451
4,646,375 3/1987 Parker ..... 5/498
4,660,240 4/1987 Hutton et al. ..... 5/451

*Primary Examiner*—Alexander Grosz
*Attorney, Agent, or Firm*—Lawrence R. Fraley

[57] ABSTRACT

A waterbed and holder assembly for use therewith wherein the holder assembly comprises a U-shaped base member for being secured to the waterbed's frame, an expandable, resilient member (e.g., elastic fabric material) for being secured at one end to an article of the waterbed's bedclothing (e.g., sheet) and for being releasably secured at the other end to the U-shaped base member, a first retention means comprising cooperating adhesive materials for providing the resilient member's releasable securement, and a second retention means (e.g., removable cover) for engaging the resilient member to retain it against the base member. Positioning and securement of the article of bedclothing in an expeditious manner is thus provided.

14 Claims, 6 Drawing Figures

WATERBED AND HOLDER ASSEMBLY FOR USE THEREWITH

This is a divisional of co-pending application Ser. No. 867,534, filed on May 28, 1986, now U.S. Pat. No. 4,683,602.

TECHNICAL FIELD

The invention relates to waterbeds and particularly to holder assemblies for use with waterbeds for securing an article (or articles) of bedclothing in proper position on the waterbed's fluid-containing mattress.

BACKGROUND

The type of bed including a frame having a fluid-containing mattress therein, often referred to as a "waterbed", has gained relative widespread recognition in recent years. A primary reason for this has been the claimed increase in sleeping comfort when compared to the conventional bed (e.g., that containing a box spring and coiled spring mattress). One acknowledged drawback of beds of this type, however, has been the inability to adequately secure the bed's bedclothing (e.g., sheets, blankets, bedspread) over the top of the fluid-containing mattress. Techniques employed to provide such securement, including those illustrated in U.S. Pat. Nos. 4,486,909 and 3,838,470, are deemed unsatisfactory because these require somewhat extensive modification to the waterbed's structure (e.g., frame) or require the utilization of several components (and manual manipulation thereof), which techniques add appreciably to the waterbed's overall cost and/or to the time and effort necessary to adequately orient the bedclothing thereon. Those devices designed specifically for securing the waterbed's fluid-impervious liner to protect against fluid leakage from the mattress, such as illustrated in U.S. Pat. Nos. 4,279,061 and 3,973,282, have typically possessed similar disadvantages. In addition, such devices have also not proven to be capable of satisfactorily retaining the waterbed's bedclothing.

It is believed, therefore, that a waterbed holder assembly capable of providing facile securement of the waterbed's bedclothing in a manner which overcomes the aforementioned disadvantages would constitute a significant advancement in the art.

DISCLOSURE OF THE INVENTION

It is, therefore, a primary object of this invention to enhance the waterbed art by providing a waterbed bedclothing holder apparatus which obviates the aforementioned disadvantages of existing such devices.

It is another object of this invention to provide a holder assembly for waterbed bedclothing which can be operated in a facile manner, is readily attachable to the waterbed's frame component, and which can be produced at relatively inexpensive cost.

These and other objects are accomplished in one aspect of the invention wherein there is provided a holder assembly for releasably securing an article of bedclothing to a waterbed frame. The holder assembly includes a base member for being secured to the frame, an expandable, resilient member having a first portion for being secured to the article of bedclothing and a second portion for being releasably secured to the base member, first retention means for releasably securing the second portion of the resilient member to the base member, and second retention means for engaging the expandable, resilient member to retain the expandable, resilient member against the base member.

In accordance with another aspect of the invention, thre is provided a waterbed which includes a frame, a fluid-containing mattress located substantially within the frame and surrounded thereby, and at least one holder assembly for releasably securing an article of bedclothing located on the mattress to the frame, the holder assembly including a base member for being secured to the frame, an expandable, resilient member having a first portion for being secured to the article of bedclothing and a second portion for being releasably secured to the base member, first retention means for releasably securing the second portion of the resilient member to the base member, and second retention means for engaging the expandable, resilient member to retain the expandable, resilient member against the base member.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
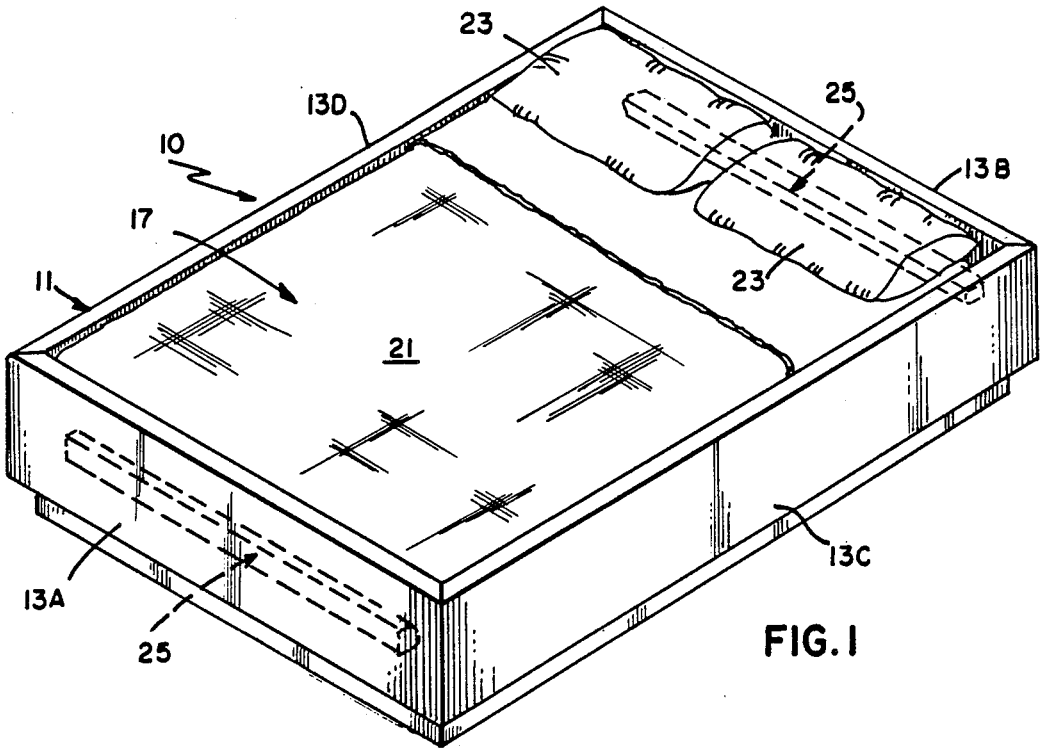
FIG. 1 is a perspective view of a waterbed capable of using the holder assembly of the instant invention.
Figure 2:
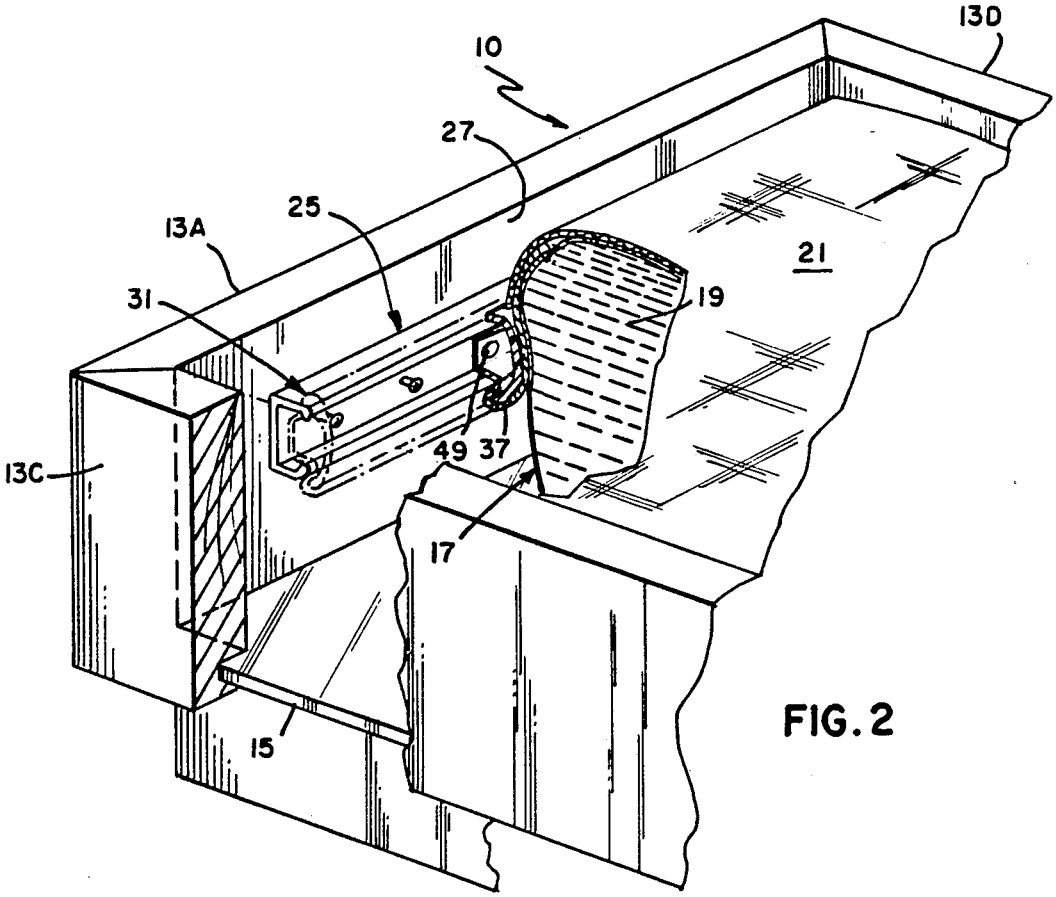
FIG. 2 is a partial perspective view, in section and on an enlarged scale, of the holder assembly of the instant invention as positioned at one end of the waterbed in FIG. 1.

With particular attention to FIGS. 1 and 2, there is shown a waterbed 10 in accordance with a preferred embodiment of the invention. Waterbed 10 includes a frame 11 of wooden or similar material and having a plurality (four) of sides 13A, 13B, 13C and 13D which are secured to a bottom wall 15 (FIG. 2). Located within frame 11 and surrounded by the frame's sides is a fluid-containing mattress 17 which includes therein the fluid 19 (e.g., water) typically utilized in waterbeds. Located on top of mattress 17 is the bedclothing 21. By the term bedclothing is meant to include sheets, blankets and bedcovers as typically utilized in both conventional bed and waterbed units. Waterbed 10 is also shown in FIG. 1 as including a pair of pillow members 23 which, as is well known, serve to provide support for the heads of those individuals occupying the waterbed.

Figure 3:
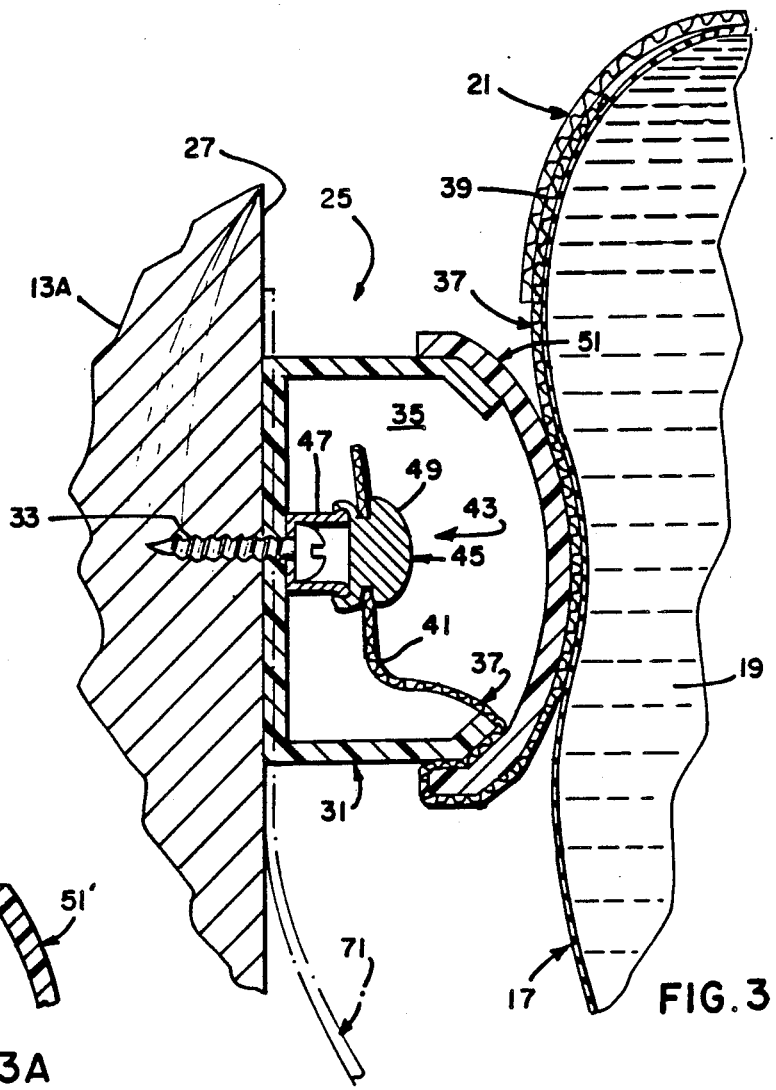
FIG. 3 is a partial elevational view, in section and on an enlarged scale, of the holder assembly of FIG. 2.

With particular attention to FIG. 2, waterbed 10 further includes at least one holder assembly 25 in accordance with a preferred embodiment of the invention. Holder assembly 25 is designed for releasably securing an article of bedclothing 21 as located on mattress 17 to the waterbed's frame structure 11. In a preferred embodiment, two such assemblies 25 are utilized, each being positioned on a side of the frame opposite the other. As shown in FIG. 1, a preferred arrangement is to position the holder assemblies on opposing sides 13A and 13B, representing the foot and head portions, respectively, of waterbed 10. Assemblies 25 are represented by hidden lines in FIG. 1. The illustrated deployment of such assemblies as shown in FIG. 1 is not meant to limit the scope of the invention, however, in that alternative placements (e.g., along the longitudinal sides 13C and 13D) is readily possible. As shown in FIGS. 2 and 3, holder assembly 25 is secured to an inner surface 27 of the respective side (13A) of frame 11 and thus lies immediately adjacent mattress 17.

In accordance with the teachings herein, holder assembly 25 includes a base member 31 of U-shaped, elongated configuration which is designed for being secured to the aforementioned inner surface 27. Base member 31 is secured by a plurality of screws 33 spacedly located along the elongated base member. In one example, a total of five screws were utilized for a base member having a length of about seventy inches. Being of U-shaped configuration, base member 31 defines an elongated channel 35 (FIG. 3) therein.

Holder assembly 25 further includes an expandable, resilient member 37 (see especially FIG. 3) which includes a first portion 39 designed for being secured to the article of bedclothing 21. In the embodiment depicted in FIG. 3, this article of bedclothing is preferably a sheet which lies immediately atop mattress 17. As stated, this is not meant to limit the invention, however, in that resilient member 37 could also be secured to a blanket, bedcover, or to yet another sheet as typically used in conventional and waterbed units. The aforementioned first portion 39 of resilient member 37 may be secured to the sheet by being sewn thereto, using buttons (not shown) or the like, or by the use of cooperating patches of fastener material such as Velcro brand fabric. Accordingly, it is possible that the resilient member 37 may be permanently or releasably attached to the end of the sheet.

As also shown in FIG. 3, resilient member 37 further includes a second portion 41 which is designed for being releasably secured to base member 31. In accordance with the teachings herein, this is accomplished through the provision of a first retention means 43 which, as shown in FIG. 3, comprises at least one snap fastener member 45 which in turn includes a base element 47 secured to the U-shaped base member 31 by the attachment screw 33. In addition, the snap fastener member includes a cap element 49 which is secured to or forms part of the resilient member's second portion 41. In one example of the invention, a total of five snap fastener members were utilized, each coinciding with the aforementined number of screws 33 used to secure base member 31 to side 13A. The base element 47, as shown in FIG. 3, is hollow and includes an aperture within the bottom thereof to allow passage of screw 33 therethrough to enable securement of element 47 in the manner depicted. The described cap element 49 frictionally engages the periphery of element 47 and can thus be readily removed therefrom. Portions of the described holder assembly 25, as well as the described mattress and bedclothing elements, have been removed in FIG. 2 for illustration purposes. Accordingly, it is understood that the resilient member 37 possesses an overall length substantially similar to that of the elongated U-shaped base member 31.

As is also understood, the expandable, resilient member 37 represents a key component of the instant invention. The ability of this component to expand and thus stretch in the manner defined is deemed to constitute a significant aspect of this invention. For example, this feature contributes significantly to assuring facile detachment of the respective article of bedclothing while still assuring sufficient securement thereof. In one example of the invention, resilient member 37 was comprised of an elastic fabric material sold under the trademark "Second Skin Cloth" by Minnetonka Mills, Inc. of Hopkins, Minn. This material is comprised of Nylon and a synthetic fiber Lycra (a trademark of the E.I. Dupont De Nemours & Co., Wilmington, Delaware) in established proportions (e.g., 85 percent Nylon, 15 percent Lycra) and possesses sufficient elasticity to satisfactorily function in the manner defined herein. The use of this material is not meant to limit the invention, however, in that other acceptable elastic materials are readily capable of being utilized herein.

Figure 3A:
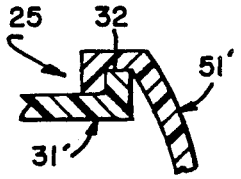
FIG. 3A is a partial elevational view, in section and on an enalrged scale, of an alternative embodiment of the base member and second retention means of the invention.

As further shown in FIG. 3, holder assembly 25 also includes a second retention means 51 which is designed for engaging resilient member 37 to retain this member against base member 31. Second retention means 51 is shown in FIG. 3 as including a curvilinear cover which secures to the upstanding, outer walls of the U-shaped base member 31. In the embodiment of FIG. 3, this securement is frictional in nature to enable facile removal of the cover when desired. In an alternative embodiment, as depicted in FIG. 3A, the U-shaped base member 31' may include an outer flange 32 projecting outwardly from both side walls thereof (the bottom wall not shown in FIG. 3A) such that the second retention means 51' can clamp thereto in a type of releasable locking form of engagement. That is, both side walls are still capable of being inwardly flexed in the embodiment of FIG. 3A to thereby facilitate release (and securement) of means 51'. Second retention means 51 (and 51') retains the resilient member 37 in the region of the second portion 41 thereof such that this part of resilient member 37 is compressed between the cover and U-shaped base member along a lower (bottom) section thereof. In addition, it is also possible that the resilient member 37 may be compressed between the waterbed's mattress 17 and the cover 51 (or 51'). This is not necessary for satisfactory retention of resilient member 37, however, and should not, therefore, limit the scope of the invention as defined herein.

In a preferred example, the U-shaped base member and the curvilinear cover (second retention means) were both comprised of plastic material, with one example being polyvinylchloride (PVC). Other materials of this type can also be satisfactorily used. Of significance, it is preferred that the projecting side walls of the U-shaped base member 31 be capable of flexing inwardly during positioning of the second retention means 51 thereon to assure the aforementioned engagement between these components. Alternatively, the curvilinear second retention means may be of sufficient resilience to provide such flexure during this engagement.

Figure 4:
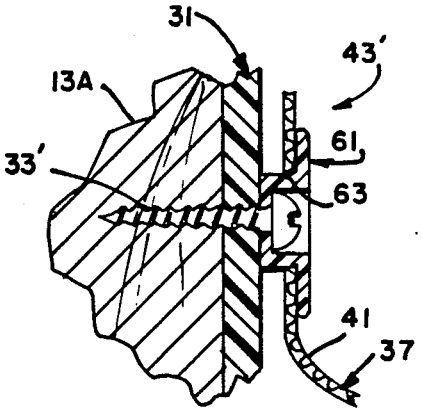
FIGS. 4 and 5 represent partial enlarged views, in section, of alternative embodiments of retention means for use as part of the holder assembly of the instant invention.
Figure 5:
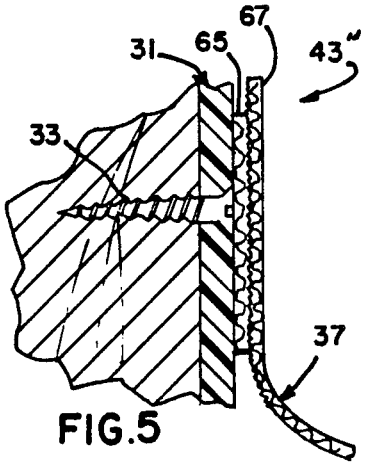

In FIGS. 4 and 5, there are illustrated alternative embodiments of the first retention means of the instant invention. In FIG. 4, retention means 43' is shown as including at least one button member 61 which is secured to or forms part of the U-shaped base member 31. A screw 33' similar to that in FIG. 3 is used to secure button 61 to the bottom wall of base member 31. A hole is provided within button 61 through which screw 33' passes. In turn, the second portion 41 of the invention's resilient member 37 includes a hold 63 therein through which the flange segment of button 61 passes. Thus the button 61 is inserted within hole 63 to provide the releasable securement of resilient member 37.

In FIG. 5, the invention's first retention means 43" is shown as including first and second cooperating adhesive members 65 and 67 respectively which provide the desired releasable securement of resilient member 37. As shown, this adhesive material (the aforementioned Velcro may be utilized) is located on an end portion of resilient member 37 for engaging the adhesive material 65 shown as being secured to the bottom wall of base member 31. A glue or other suitable adhesive material may be used to secure the first adhesive member 65 to base member 31. Accordingly, the outer surface of this member will include the adhesive material (e.g., Velcro) for cooperatively engaging resilient member 37.

There has thus been shown and described a waterbed and a holder assembly for use therewith wherein the holder assembly is designed for releasably securing an article of bedclothing to the waterbed's frame structure in such a manner that release of the article of bedclothing so secured can be achieved in an expeditious manner. The holder assembly as defined herein is of relatively simple construction and can be easily attached to existing waterbed frame structures without expensive modification thereto. Of equal significance, this relatively simple construction assures a product which can be produced at relatively low cost and on a mass production basis.

While there have been shown and described what are at present considered the preferred embodiments of the invention, it will be obvious to those skilled in the art that various changes and modifications may be made therein without departing from the scope of the invention as defined by the appended claims. For example, it is within the scope of the instant invention to utilize the holder assembly as defined herein to also retain the liner of the waterbed, if utilized. Such a liner is shown in phantom in FIG. 3 and represented by the numeral 71. Securement of this liner to the waterbed frame can be accomplished by merely passing the retention screws 33 therethrough such that the bottom wall of the U-shaped base member serves to compress the liner against the illustrated side 13A of the frame to thereby adequately maintain the liner in position.

I claim:

1. A holder assembly for releasably securing an article of bedclothing to a waterbed frame, said holder assembly comprising:

a base member for being secured to said frame;

an expandable, resilient member having a first portion for being secured to said article of bedclothing and a second portion for being releasably secured to said base member;

first retention means for releasably securing said second portion of said expandable, resilient member to said base member, said first retention means including first and second cooperating adhesive materials for being releasably secured along a common surface thereof; and second retention means for engaging said expandable, resilient member to retain said expandable, resilient member against said base member.

2. The holder assembly according to claim 1 wherein said base member is of substantially U-shaped, elongated configuration and defines a channel therein.

3. The holder assembly according to claim 2 wherein said base member is fixedly secured to an internal surface of said frame.

4. The holder assembly according to claim 3 wherein said base member is secured by at least one screw.

5. The holder assembly according to claim 1 wherein said expandable, resilient member is comprised of an elastic material.

6. The holder assembly according to claim 5 wherein said second retention means comprises a cover member for being releasably secured to said base member, said cover member compressing said elastic material against said base member when secured to said base member.

7. The holder assembly according to claim 5 wherein said base member and said cover member are each comprised of plastic.

8. A waterbed comprising:

a frame;

a fluid-containing mattress located substantially within said frame and surrounded thereby; and at least one holder assembly for releasably securing an article of bedclothing located on said mattress to said frame, said holder assembly including a base member for being secured to said frame, an expandable, resilient member having a first portion for being secured to said article of bedclothing and a second portion of being releasably secured to said base member, first retention means for releasably securing said second portion of said expandable, resilient member to said base member, said first retention means including first and second cooperating adhesive materials for being releasably secured along a common surface thereof, and second retention means for engaging said expandable, resilient member to retain said expandable, resilient member against said base member.

9. The waterbed according to claim 8 wherein the number of said holder assemblies is two, each of said holder assemblies being secured to said frame along opposing sides thereof.

10. The waterbed according to claim 8 wherein said base member is of substantially U-shaped, elongated configuration and defines a channel therein, said base member being fixedly secured to an internal surface of said frame.

11. The waterbed according to claim 10 wherein said base member of said holder assembly is secured by at least one screw.

12. The waterbed according to claim 8 wherein said expandable, resilient member of said holder assembly is comprised of an elastic material.

13. The waterbed according to claim 12 wherein said second retention means of said holder assembly comprises a cover member for being releasably secured to said base member, said cover member compressing said elastic material against said base member when secured to said base member.

14. The waterbed according to claim 13 wherein said base member and said cover member are each comprised of plastic material.

* * * * *